US005174649A

United States Patent [19]

Alston

[11] Patent Number: 5,174,649

[45] Date of Patent: Dec. 29, 1992

[54] LED LAMP INCLUDING REFRACTIVE LENS ELEMENT

[75] Inventor: Kevin G. Alston, Wylie, Tex.

[73] Assignee: Precision Solar Controls Inc., Garland, Tex.

[21] Appl. No.: 731,621

[22] Filed: Jul. 17, 1991

[51] Int. Cl.[5] ..... F21V 5/00

[52] U.S. Cl. ..... 362/244; 362/309; 362/332; 362/800

[58] Field of Search ..... 362/244, 236, 237, 268, 362/308, 309, 331, 332, 335, 800; 359/622, 624, 794

[56] References Cited

U.S. PATENT DOCUMENTS

| | | | |
|---|---|---|---|
| 1,342,894 | 6/1920 | Bugbee | 362/268 |
| 1,977,120 | 10/1934 | Dirkes et al. | 362/268 |
| 2,082,100 | 6/1937 | Dorey et al. . | |
| 2,215,203 | 9/1940 | Young | 362/268 |
| 2,401,171 | 5/1946 | Leppert . | |
| 3,035,486 | 5/1962 | Benford | 362/268 |
| 3,302,517 | 2/1967 | Henkel | 362/268 |
| 3,522,424 | 8/1970 | Fritsch | 362/268 |
| 4,330,813 | 5/1982 | Deutsch | 362/244 |
| 4,425,604 | 1/1984 | Imai et al. . | |
| 4,619,508 | 10/1986 | Shibuya et al. | 362/268 |
| 4,684,919 | 8/1987 | Hihi . | |
| 4,733,335 | 5/1988 | Serizawa et al. | 362/800 |
| 4,935,665 | 6/1990 | Murata | 362/800 |
| 4,953,937 | 9/1990 | Kiruchi et al. | 362/335 |

OTHER PUBLICATIONS

"Shut Light", The Furukawa Battery co., Ltd., Sales Brochure.

*Primary Examiner*—Richard R. Cole

*Attorney, Agent, or Firm*—Mason, Fenwick & Lawrence

[57] ABSTRACT

A lamp includes one or more LED's which illuminate respective portions of a refractive lens element whose incident surface preferably includes portions of hyperboloids which translate the LEDs' emitted rays into substantially parallel beams within the lens element. The lens element's exit surface is preferably an array of facets configured to provide a desired beam spread pattern, allowing precise tailoring of the resultant output beam pattern. The plurality of facets also allows a larger area on the lamp to appear to viewers to be uniformly illuminated, thus providing full target size definition at a decreased cost and with reduced power consumption.

40 Claims, 4 Drawing Sheets

LED LAMP INCLUDING REFRACTIVE LENS ELEMENT

BACKGROUND OF THE INVENTION

1. Field of the Invention

The present invention relates to lamps and other illumination devices. More specifically, the invention relates to LED-based lamps using minimum power to illuminate a chosen area.

2. Related Art

In the field of illumination devices, there has long been a trade-off between brightness and power conservation. It is known that the use of light emitting diodes (LED's) consume substantially less power than incandescent light bulbs. However, typically, the radiant power of LED's has been limited so that they have been used for primarily short-range applications such as panel indicators or indoor signs. LED's have proven useful when their size has not been a significant factor because they are viewed from small distances. Unfortunately, use of LED's in outdoor applications such as traffic lights has been limited, due to high levels of ambient light. Even with the advent of "ultra-bright" LED's, large clusters of LED's are required to achieve adequate target-size definition. The longer distances involved in outdoor illumination devices, brighter ambient light conditions, and limits of resolution of the human eye are among factors which require clusters of large numbers of LED's in known systems. Unfortunately, these clusters are expensive and consume a considerable amount of power.

Various known systems have been involved in optically enhancing a light source. For example, U.S. Pat. No. 2,082,100 (Dorey et al.) discloses a light-spreading lens in which light radiating from a point source passes through a plate including several prismatic lenses to exit in a substantially parallel fashion. U.S. Pat. No. 2,401,171 (Leppert) discloses a traffic signal in which lamp light passes through a plurality of lenses before exiting the structure. Finally, U.S. Pat. Nos. 4,425,604 (Imai et al.) and 4,684,919 (Hihi) disclose illumination devices in which light reflects off elliptical surfaces or a plurality of prismatic surfaces before exiting.

Unfortunately, none of the known systems involve optimum use of light within the beam angle of LED's so as to provide signs of enough brightness for outdoor signs or traffic signals while still minimizing power consumption.

SUMMARY OF THE INVENTION

The present invention provides a solution to the abovedescribed problems.

The present invention provides a lamp in which one or more LED's illuminate respective portions of a refractive lens element whose incident surface preferably includes portions of hyperboloids which translate the LEDs' emitted rays into substantially parallel beams within the lens element. The lens element's exit surface is preferably an array of facets configured to provide a desired beam spread pattern, allowing precise tailoring of the resultant output beam pattern. The plurality of facets also allows a greater area on the lamp to appear uniformly illuminated, thus providing full target-sized definition at a decreased cost and with reduced power consumption.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1A:
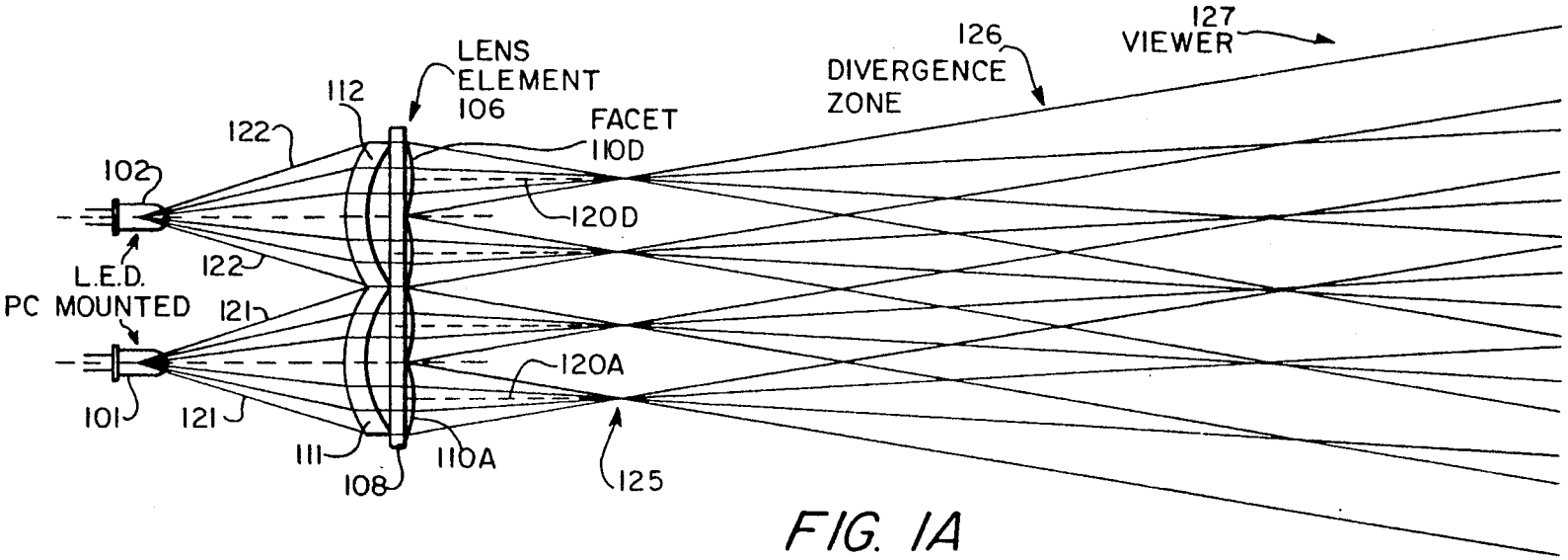
FIGS. 1A and 1B present top and side views, respectively, of four LED's illuminating a preferred embodiment of a refractive lens element according to the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. Furthermore, directional indicators such as "top", "bottom", "left", "right", N, S, E, W, NW, NE, SW, SE, and so forth, are provided for the convenience of the reader in referencing particular elements or relationships of elements in exemplary embodiments of the invention, but do not in any way limit the invention to such orientations or configurations.

Figure 1B:
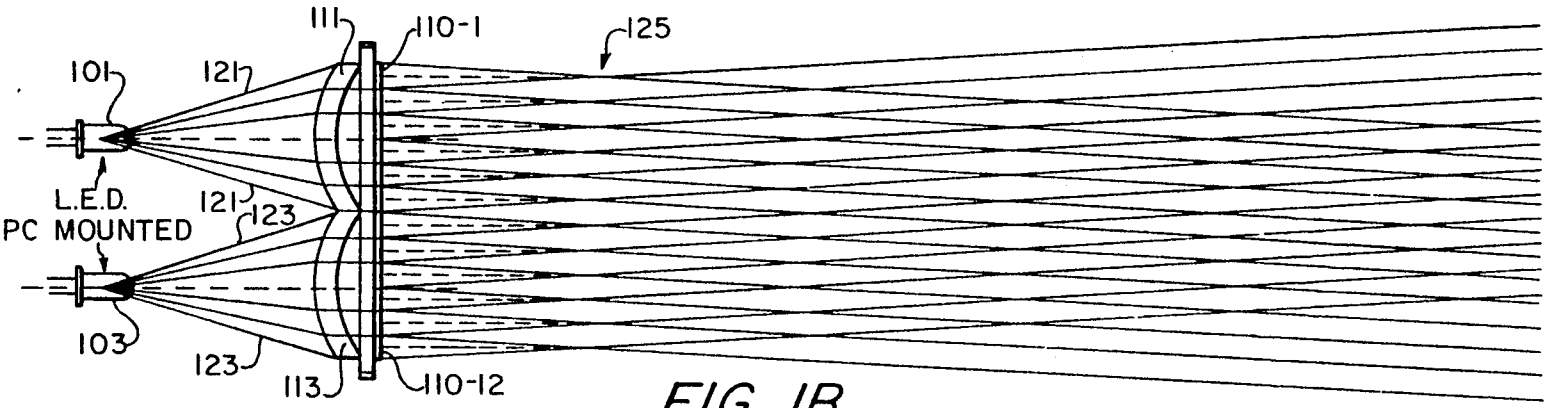
Figure 2:
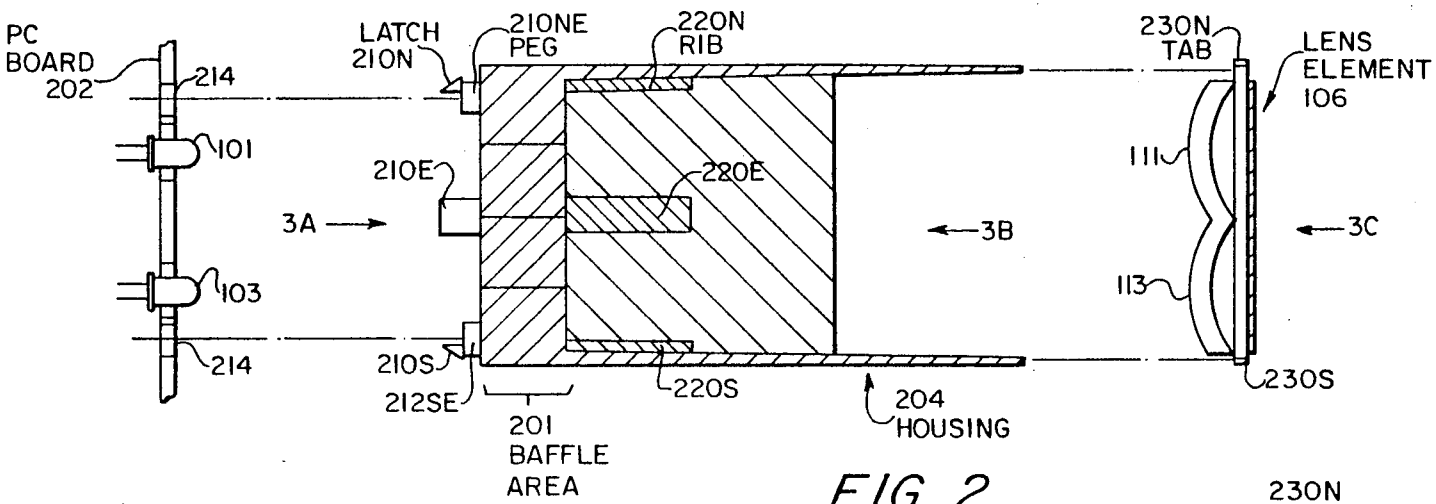
FIG. 2 is an exploded side view showing the LED's on a printed circuit board, a housing, and the refractive lens element.

Referring now to the drawing figures, especially FIGS. 1A and 1B, the structure and principles of operation of a preferred embodiment of the invention are presented. In the illustrated embodiment, it is assumed that four LED's 101, 102, 103, and 104 (see especially FIG. 3B) are provided on a printed circuit board 202 (FIG. 2). Arranged substantially parallel to the printed circuit board, perpendicular to main axes of the LED's, a lens element 106 is provided.

The lens element 106 includes a square body 108 which is seen from the edge in FIGS. 1A, 1B. Hyperboloid-section surfaces 111, 112, 113, 114 constitute the incident surfaces for light emitted by respective LED's 101, 102, 103, 104. The outer (exit) surface of the lens element 106 includes an array of facets provided in a row end column arrangement. Columns 110A and 110B (FIGS. 1A and 3C) are provided for LED's 101 and 103, while facet columns 110C and 110D are provided for LED's 102 and 104. Similarly, rows of facets 110-1 through 110-6 (FIGS. 1B and 3C) are provided for LED's 101 and 102, while rows of facets 110-7 through 110-12 are provided for LED's 103 and 104.

Preferably, embodiments of the invention employ LED's which have a specified beam angle, which beam angle generally defines a cone-shaped space within which most of the LED's luminous energy travels. Preferably, a minimal fraction of the luminous energy from the LED's travels outside the beam angles. In FIGS. 1A and 1B, the beam angles for LED's 101, 102, 103 are defined by lines 121, 122, 123, respectively.

The hyperboloidal surfaces 111–114 are dimensioned to intercept the edges of the beam width when the LED is oriented at a focal point. Thereby, a maximum amount of luminous energy enters the lens element 106. Each LED lies at the focus of the second branch of its respective hyperboloidal surface. In this manner, the acceptance angle of the hyperboloidal surface, also known as its numerical aperture, and the index of refraction of the lens element 106 are such that the emitted light is refracted into a series of parallel intra-lens beams after it enters the lens element. More specifically, as illustrated in FIG. 1A, after light from LED 102 passes through hyperboloidal surface 112, all portions of the beam are substantially parallel while passing through the solid lens element body including hyperboloidal surface 112, square body 108, and facets 110. In the illustrated embodiment hyperboloidal surface 112, square body 108, and facets 110 are integrally formed into lens 106, although this is not necessary in all embodiments of the invention.

If the LED has a narrower beam, a longer hyperboloid focal length must be chosen in order to have its full aperture illuminated. Conversely, if the LED has a broader beam width, the hyperboloid's focal length must be shorter, in order to intercept all or most of the emitted energy. Thus, the choice of LED and the design of the lens element are interacting considerations, allowing the designer flexibility in construction of the lamp.

For purposes of illustration, the propagation of light from the lens element 106 will be described with reference to the top view (FIG. 1A), with the understanding that similar principles apply to the side view (FIG. 1B). As shown in FIG. 1A, each facet 110A–110D passes a beam having a beam center 120A–120D, respectively. Because the facets are convex, the parallel beams passing through the lens element 106 converge toward the respective beam centers, crossing each other at a plane 125. Thereafter, the beams enter a divergence zone, generally indicated as 126, and propagate toward the viewer 127.

In accordance with principles known to those skilled in the art, the amount of curvature of the facets 110 determines the output beam pattern experienced by the viewer. For example, imparting a smaller radius of curvature to the facets 110 cause the beams to converge at plane 125 nearer the lens elements, and then diverge at a greater angle, resulting in a wider, more diffuse beam. Conversely, increasing the radius of curvature of facets 110 causes the light to converge at a greater distance from the lens element and diverge more slowly, resulting in a narrower, more concentrated beam.

In the illustrated embodiment, the outer surfaces of facets 110 are convex, and have a horizontal width greater than its vertical height. Viewed from above (FIG. 1A), the facets are shown to constitute a portion of a sphere traversing a horizontal angle of 36° 42′. Viewed from the side (FIG. 1B) the facets are shown to constitute a portion of a sphere traversing a vertical angle of 12°2′. The resultant desired output beam subtending a projected angle of about 18° horizontally and 6° vertically. This design provides a divergent beam pattern which is wider than it is high, as is desired in many applications. As an example, in the case of an eye-level display sign, it is desirable that the horizontal beam width be wider than the vertical beam width, because viewers of the sign have a greater range of movement horizontally than vertically as they walk by.

Figure 1C:
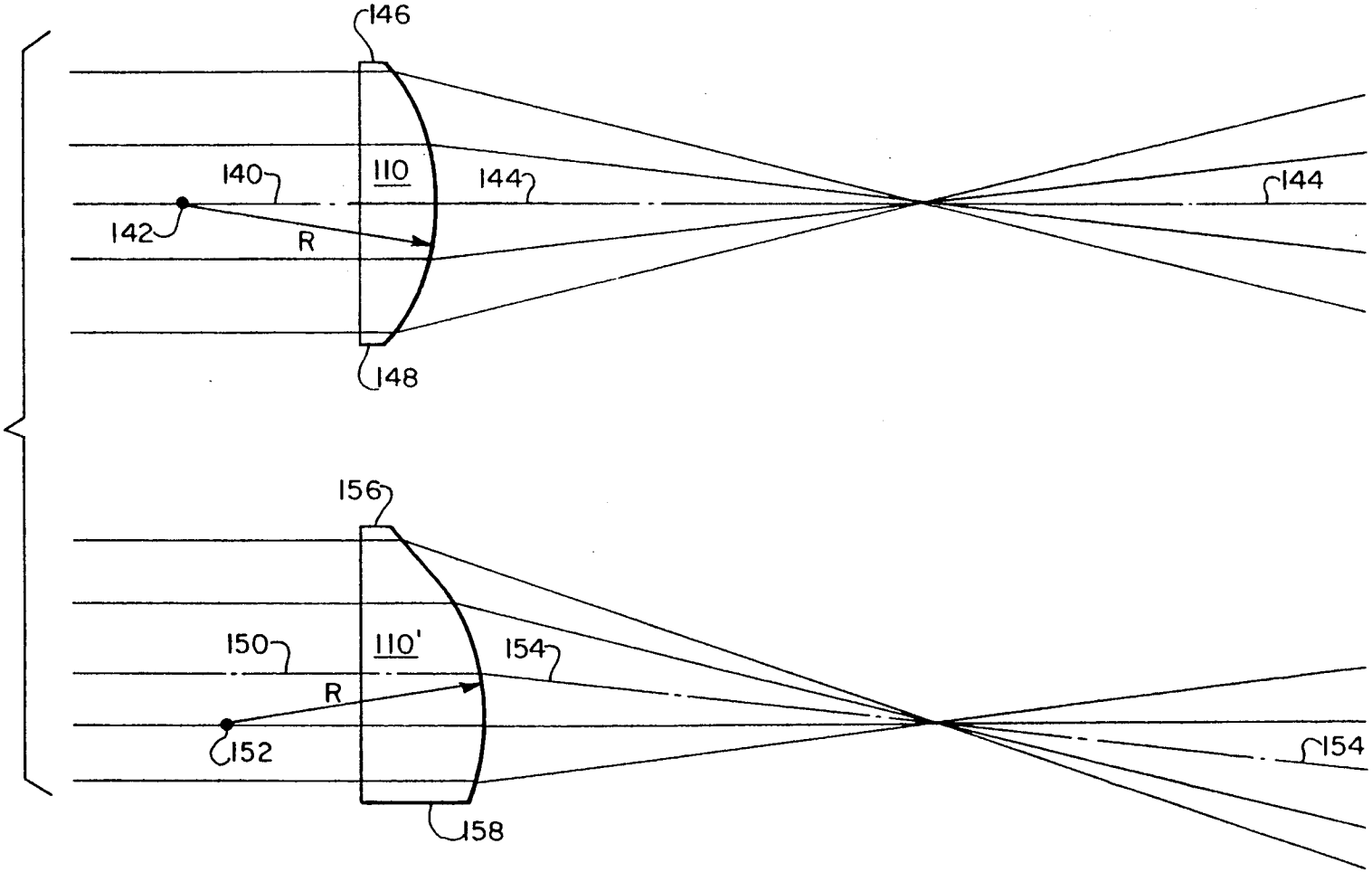
FIG. 1C presents two sectional schematic views illustrating, respectively, a facet whose center of curvature is centered with respect to the linear center of the facet, and a facet in which the center of curvature is off-center to allow skewing of the beam diverging from the facet.

The invention also provides that the facets may be off center, as illustrated in FIG. 1C. The top and bottom portions of FIG. 1C show facets in what may be considered either a top view or a side view, the principles being applicable regardless of the physical orientation of the facet.

The center of curvature 140 of the first facet 110 is illustrated on the physical center line 140 of the facet, the center line 140 being defined as equidistant from first and second facet edges 146, 148 and parallel to the light within the lens element. This first configuration results in a divergent light beam having a center line 144 which is parallel to the light within the lens element. In this case, the light comes "straight" out of the lens element, the situation which was illustrated in FIGS. 1A and 1B.

In contrast, the center of curvature 152 of the second facet 110′ is illustrated as being off the physical center line 150 of the facet, the center line 150 still being defined as equidistant from first and second facet edges 156, 158 and parallel to the light within the lens element. This second configuration results in a divergent light beam having a center line 154 which is skewed with respect to the light within the lens element. In this manner, the light is "pointed" to one side of the lens element, and does not come "straight out of" the lamp.

Although FIG. 1C is a two dimensional drawing showing a divergent light beam skewed in one direction, the invention provides that the center of curvature may be designed off-center in both the horizontal and vertical directions. This design allows the divergent beam to be skewed in any direction, regardless of the orientation of any horizontal and vertical edges of the facets in a particular lamp.

In this manner, applications in which non-symmetric distribution patterns are desired can readily be accommodated, according to the invention. For example, it is generally undesirable for a traffic light to project light upward, as all intended viewers will be either at the same height as, or lower than, the traffic light itself. Therefore, for traffic lights, it is desirable to direct the beam horizontally and downward, so that light energy is not wasted by being directed uselessly into the sky. If the light is properly directed horizontally and downward, maximum brightness is experienced for a given power consumption.

It lies within the contemplation of the invention that the facets 110 be concave instead of convex. When the facets are concave, the light beams exiting the lens will begin to diverge immediately, rather than converge at a crossing plane 125 before diverging. However, as illustrated, the preferred embodiment includes convex lenses because any sun hoods or other physical objects immediately above or below the beams might otherwise block some of the light exiting the lens element.

Figure 1D:
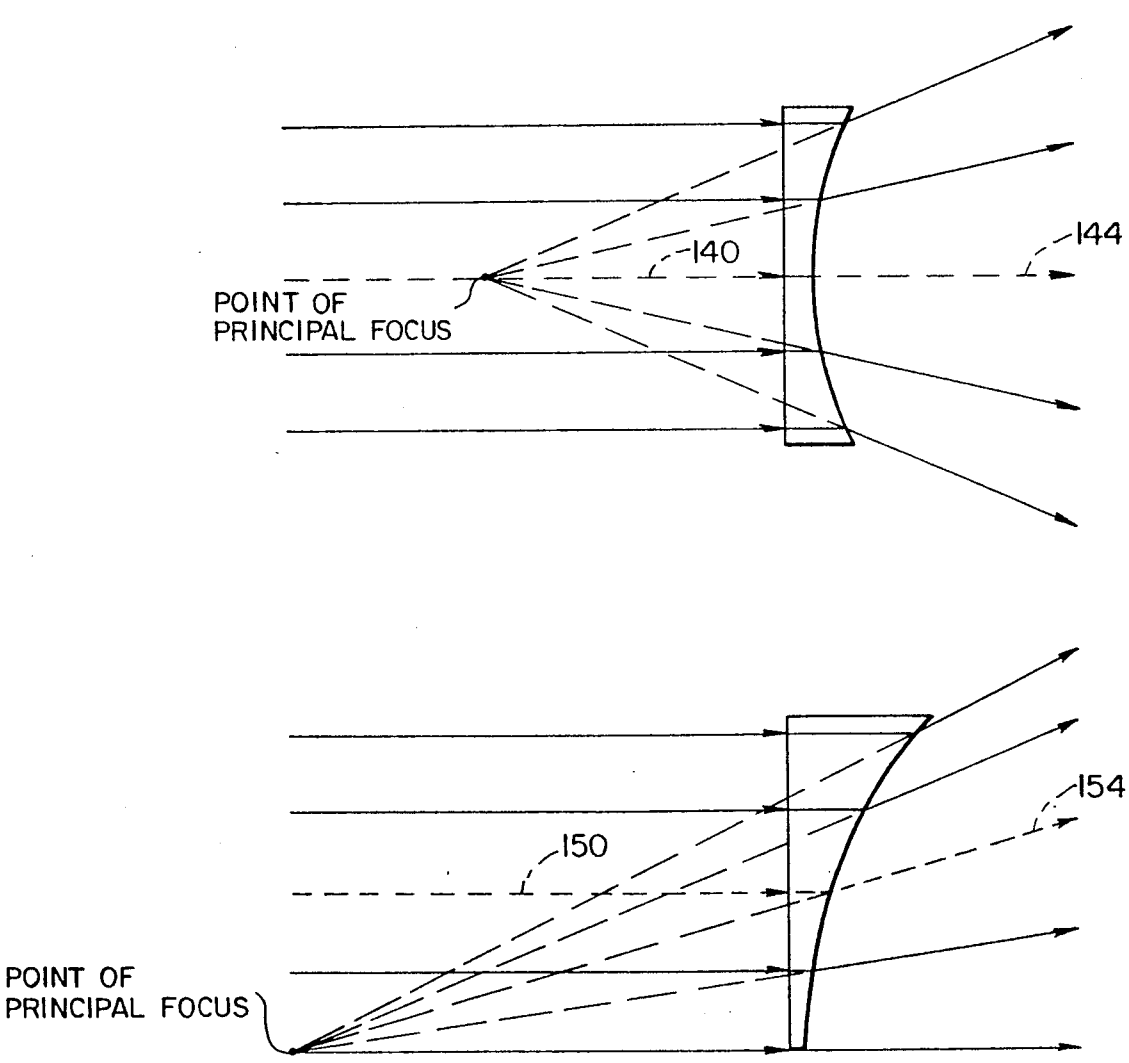
FIG. 1D is similar to FIG. 1C, with the exception that the exit surfaces are concave instead of convex.

For completeness, Applicant provides FIG. 1D, which corresponds to FIG. 1C with the exception that the exit surfaces are concave instead of convex. In view of the foregoing discussion, those skilled in the art are readily capable of understanding that, with a concave exit surface, the exiting light beam spreads without converging. In this respect, the configuration of FIG. 1D may be considered unacceptable for certain applications for the reasons discussed immediately above.

Referring now especially to FIG. 2, a preferred embodiment of the illumination device according to the present invention is illustrated in an exploded side view. The LED's 101, 103 are shown installed on a printed circuit board 202 which may be of standard design. The lens element 106 is illustrated at the opposite side of FIG. 2. A housing 204 is shown aligned between the LED's and the lens element.

Figure 3C:
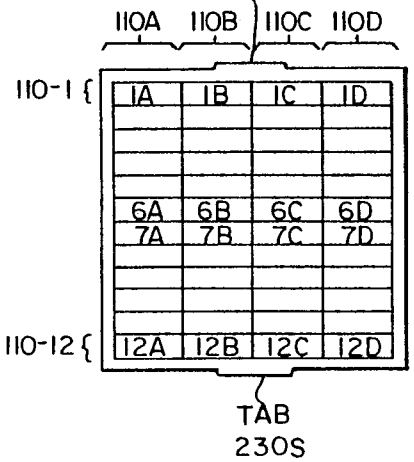
FIG. 3C is an end view of the refractive lens element as viewed from direction 3C (FIG. 2), especially illustrating the rows and columns of facets forming the exit surface of the refractive lens element.
Figure 3B:
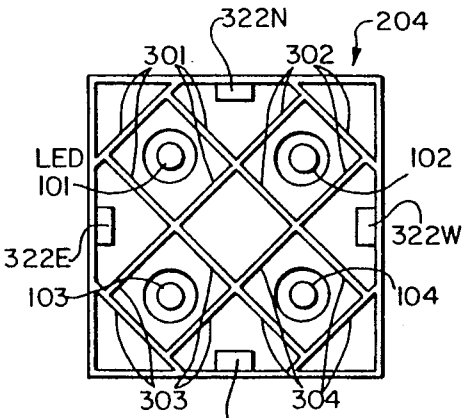
FIG. 3B illustrates the housing and printed circuit board as viewed from direction 3B (FIG. 2).
Figure 3A:
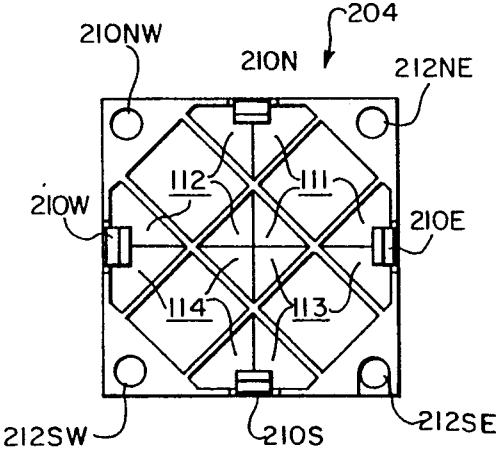
FIG. 3A illustrates the housing and refractive lens element viewed from direction 3A (FIG. 2).

The left portion of the housing 204 attaches to printed circuit board 202 by means of four latch members 210N, 210E, 210S, and 210W (see FIG. 3A). Latch members 210N, 210E, 210S, and 210W are provided with 0.85 by 0.09 inch slots on both sides at their point of attachment to the housing (FIG. 3A), to provide them with more physical flexibility and to facilitate assembly of the device. Latches 210 matingly engage corresponding holes in the printed circuit board 202. For stabilizing the relative locations of the printed circuit board and housing, pegs 210NW, 210NE, 210SE, and 210SW (see also FIG. 3A) are provided. The cylindrical pegs fit within cylindrical apertures in the printed circuit board, preventing rotational movement of the housing.

The housing 204 is provided with a baffle area 201. Baffle area 201 provides a set of four "tunnels" arranged parallel to the axes of the respective LED's beam patterns. The baffles function as the "tunnels" to minimize the amount of light which would fall upon the LED's to make them appear to be turned on when they were in fact off. The baffles thus improve the on-off contrast of the lamp.

The housing is also provided with four interior ribs 220N, 220E, 220S, and 220W positioned parallel to the baffles and extending inward from the outer wall of the housing. Lens element 106 is inserted into the right side of housing 204 (as viewed in FIG. 2) until it contacts the end of the ribs. The top surface 220N and the bottom surface 220S of the housing 204 are provided with apertures at the end of ribs 220N, 220S (FIG. 2) to receive tabs 230N, 230S, respectively, provided on the top and bottom of the lens element (FIG. 3C). In this manner, the lens element may be removably snapped into place in the housing.

Referring now to FIG. 3A, a view of the housing 204 and lens element 106 is provided, as if seen from the position of the printed circuit board in FIG. 2. The four latches 210 and the four pegs 212 are illustrated, projecting out of the plane of the paper, indicating where the corresponding apertures are located on the printed circuit board to receive them. The four hyperboloidal surfaces 111, 112, 113, 114 are visible through the baffles.

FIG. 3B is a view of the LED's on the circuit board as seen through the housing, as if seen from a view 3B (FIG. 2). As shown more clearly in FIG. 3B, the four LED's 101, 102, 103, 104 are aligned within respective baffles 301, 302, 303, 304. Each baffle includes four surfaces perpendicular to the plane of the printed circuit board 202, parallel to the axes of the LED beams. When the housing is attached to the printed circuit board, the baffles are positioned against the surface of the printed circuit board, so that no light falls upon the LED's from the side. The positioning of these baffles ensures that a darkened LED does not falsely appear to be illuminated due to light incident on the LED being reflected by the LED and thence passing through the lens element.

FIG. 3B also illustrates the ends 322N, 322W, 322S, 322E of ribs 220N, 220W, 220S, 220E, respectively (FIG. 2). The lens element 106 (FIG. 2) is inserted into the housing until the edges of its incident face contacts these surfaces 322.

FIG. 3C is a view of the outside of the lens element from view 3C (FIG. 2). FIG. 3C illustrates the array of facets 110 which are present in a preferred embodiment. As described briefly above, with reference to FIGS. 1A and 1B, the facets are arranged in four columns 110A through 110D, and 12 rows 110-1 through 110-12. This embodiment of the lens element thus includes 48 facets. Light from each of the four LED's passes through respective quadrants of 12 facets each. In particular, light emitted by LED 101 passes into hyperboloid 111 and passes out of the lens element through the twelve facets 1A through 6A and 1B through 6B. Similarly, light emitted by LED 102 passes into hyperboloid 112 and out the twelve facets 1C through 6C and 1D through 6D. Finally, LED's 103, 104 emit light passing into hyperboloids 113, 114 and out facet 7A–12A, 7B–12B and 7C–12C, 7D–12D, respectively.

As appreciated by those skilled in the art in light of the present description, the shape of the output light beam exiting the facets is dependent on a number of design parameters, including the following:

1. The total number of facets determines how many times the LED is "reproduced" to convey the impression of a uniformly illuminated surface. A uniformly illuminated surface is especially desirable in applications such as traffic signals.

2. The relative shape of the facets (the ratio of the linear horizontal and vertical dimensions, when viewed end-on) affects the number of times the LED is effectively "reproduced", for a given overall lens element size and radius of curvature. This directly affects the appearance of uniform illumination. Further, assuming a given radius of curvature, the ratio of the beam width to beam height is directly related to the ratio of horizontal to vertical facet dimension, determining the beam spread pattern in which the lamp may be viewed.

3. The radius of curvature of the facets (in both the horizontal and vertical planes) is a main factor allowing tailoring of the diverging light beam. For given facet linear dimensions, decreasing the radii of curvature causes correspondingly wider output beams.

4. By centering the radius of curvature of the facet's exit surface away from the physical center of the facet, in either the vertical direction (elevation) or in the horizontal direction (azimuth) or both direction, the divergent beam may be skewed so as to "point" the beam upward, downward, to either side, or any combination of elevation and azimuth, as desired.

5. Employing facets of different characteristics within the same device allows tailoring of light intensity patterns as a function of angle. In this manner, the beam width as experienced by the viewer at any given distance from the lens element may be independently controlled in both the horizontal (FIG. 1A) and vertical (FIG. 1B) directions, as well as at various angles (FIG. 1C).

It is understood that the present invention envisions a wide variety of physical and optical constructions. However, for illustrative purposes, the embodiment illustrated in the drawings may be implemented using the following dimensions and materials.

The LED's may be HLMP-3950 (Hewlett-Packard, or equivalent from VCH-Chicago Miniature), having an advertised beam angle of 24° but being useful in this application with an assumed beam angle of 35°-36°. A peak wavelength of 565 nm is close to the center of the human photopic curve (555 nm).

The lens element may be made of prime grade clear acrylic, of optical clarity ranging from 92% transmissivity (uncoated) to 98% transmissivity (when coated with an anti-reflective coating). Alternatively, if a more impact-resistant material is desired, polycarbonate with UV inhibitors may be employed. The refractive index of the material in the illustrated embodiment is 1.491, the curves normalized to an assumed wavelength of 565 nanometers. The ABBE value (V) is 57.2. The hyperboloidal surfaces 111-114 may have a vertex radius of 0.96678 inches, the conic constant being −2.223081, and FFL = −1.969 inches. Square body 108 is 0.1 inches thick, 2.22 inches square, with hyperboloids 111-114 projecting 0.226 inches in one direction and the facets 110 projecting 0.045 inches in the opposite direction from the square body. When viewed end-on, each hyperboloidal surface is 1 inch square, so that the four hyperboloidal surfaces and the 48 facets on the opposite side of the lens element comprise a 2 inch by 2 inch area. Thus, each facet is 0.1666 inches high and 0.5 inches wide. For fitting the lens element into the housing, a 0.1 inch border around all four sides is provided, with tabs 220 projecting an additional 0.04 inches outside the borders. The horizontal and vertical portions of the convex facets occupy 36 42′ and 12 2′, respectively, of a sphere of radius 0.794 inches.

The baffle region 201 is preferably 0.7 inches long, with ribs 220 being 2.195 inches long. The overall length of the housing 204 is 4.482 inches, with upper and lower edges 222N, 222S, being 0.05 inches thick with a 1° draft extending away from the housing main body.

The "tunnels" formed in the baffle region are preferably square in cross-section (FIGS. 3A, 3B), having inside measurements of 0.65 inches, the walls of the baffles being 0.05 inches thick. Pegs 212 are preferably 0.246 inches in diameter and arranged at the four corners of the surface of the housing which contacts the printed circuit board, centered 0.2 inches from the edges of the housing. A 0.105 by 0.55 inch slot is provided in both the top and bottom surfaces 222N, 222S of the housing 2.195 inches from the PC-board end of the housing, to receive 0.030-inch tabs 230N, 230S. On the printed circuit board, the LED's are located on the corners of a square having one inch sides. In a preferred embodiment, the housing is made of 10% glass-filled polycarbonate.

Modifications and variations of the above-described embodiments of the present invention are possible, as appreciated by those skilled in the art in light of the above teachings. For example, the use of more than four LED's in conjunction with larger numbers of hyperboloidal surfaces lies within the contemplation of the present invention. Similarly, the use of fewer LED's, such as a single InAlGaAs LED may be used with a single hyperboloidal surface. Moreover, different arrangements of LED's, such as in rows and columns of unequal number and/or width, also lies within the contemplation of the invention. Also, use of LED's of different colors is contemplated, as are types of electromagnetic radiation other than that which is in the spectrum visible to humans. Furthermore, use of different quantities, shapes, sizes, curvatures, and orientations of facets lies within the scope of the invention. It is therefore to be understood that, within the scope of the appended claims and their equivalents, the invention may be practiced otherwise than as specifically described.

What is claimed is:

1. An apparatus for emanating electromagnetic radiation as a desired output beam, the apparatus comprising:

a) at least one emitting device for producing an emitted beam of electromagnetic radiation; and b) a lens element including, for each emitting device:

1) an entrance surface shaped to refract the emitted beam into an intra-lens beam; and 2) an exit surface including at least two facets shaped to refract the intra-lens into the desired output beam;

wherein the emitting device is located at a focus of the lens entrance surface.

2. The apparatus of claim 1, wherein at least one of the emitting devices is a light emitting diode (LED).

3. The apparatus of claim 1, wherein the entrance surface includes a portion of a hyperboloid having a focus of which is located one of the emitting devices.

4. The apparatus of claim 1, wherein the entrance surface is shaped to refract the emitted beam into an intra-lens beam substantially all of whose electromagnetic energy travels in an essentially parallel direction.

5. The apparatus of claim 1, wherein at least one facet of the exit surface is convex.

6. The apparatus of claim 1, wherein at least one facet of the exit surface is concave.

7. The apparatus of claim 1, wherein at least one facet of the exit surface is formed with an imaginary center of curvature which is located on an imaginary center line passing midway between opposite edges of the facet and perpendicular to a line connecting the opposite edges, so that the desired output beam is substantially on-axis to the direction of the intra-lens beam.

8. The apparatus of claim 1, wherein at least one facet of the exit surface is formed with an imaginary center of curvature that is located off an imaginary center line passing midway between a first set of opposite edges of the facet and perpendicular to a line connecting the opposite edges, so that the desired output lens is skewed in a first direction with respect to the axis of the intra-lens beam.

9. The apparatus of claim 8, wherein the imaginary center of curvature is located off the imaginary center line passing midway between a second set of opposite edges of the facet and perpendicular to a line connecting the second set of opposite edges, so that the desired output beam is skewed in a second direction with respect to the axis of the intra-lens beam.

10. The apparatus of claim 1, wherein the exit surface includes:

a first facet having a first radius of curvature defining its outer surface so that it emits an output beam subtending a first angle in a first direction and a second angle in a second direction, the first facet emanating electromagnetic energy having a first beam spread; and a second facet having a second radius of curvature defining its outer surface so that it emits an output beam subtending a third angle in a third direction and a fourth angle in a fourth direction, the second facet emanating electromagnetic energy having a second beam spread;

wherein at least one of the first and second angles is not the same as a corresponding one of the third and fourth angles, so that the first beam spread is different in angularity, or intensity, or angularly and intensity, than the second beam spread.

11. The apparatus of claim 1, further comprising a housing which includes:

a baffle arrangement for each emitting device, oriented to substantially surround sides of the emitting device to minimize the amount of electromagnetic radiation which falls upon the emitting device.

12. The apparatus of claim 1, further comprising:

a) a board on which the at least one emitting device is situated; and b) a housing, including:

1) a baffle arrangement oriented around each emitting device and adjacent the board, to substantially surround sides of the emitting device to reduce the amount of electromagnetic radiation which falls upon the emitting device;

2) a first set of attachment structures for attaching the housing to the board on which the emitting devices are attached; and 3) a second attachment structure for matingly engaging a corresponding lens attachment structure on the lens element, so that the lens element may be fixed to the housing.

13. The apparatus of claim 1, wherein:

a) the at least one emitting device includes LED's, the emitted beam of the LED's having respective beam spread and beam axes; and b) the lens element is constructed and arranged so that:

1) the lens element entrance surface includes a number of hyperboloidal surfaces corresponding to the number of LED's, the hyperboloidal surfaces being centered on respective beam axes of respective LED's and having hyperboloidal surface edges generally corresponding to the respective beam spreads of the respective LED's, the hyperboloidal surfaces receiving respective emitted beams;

2) each hyperboloidal surface is shaped to refract the emitted beam into an intra-lens beam whose components travel substantially parallel paths; and 3) the facets are grouped into subsets of facets, the subsets arranged to receive intra-lens beams from respective ones of the hyperboloidal surfaces.

14. The apparatus of claim 13, wherein there are exactly four LED's, four hyperboloidal surfaces, and four rows and twelve columns of facets including four subsets of twelve facets.

15. The apparatus of claim 14, wherein each facet has an outer surface which subtends a horizontal angle of about 36°14′ and a vertical angle of about 12°2′, the resultant desired output beam subtending a projected angle of about 18° horizontally and 6° vertically.

16. The apparatus of claim wherein the emitting device includes a device for emitting electromagnetic energy lying substantially within the light spectrum visible to humans.

17. A lamp, comprising:

a) at least one LED for producing an emitted light beam, the emitted beams of the LED's having respective beam spreads and beam axes;

b) a board on which the at least one LED is situated;

c) a lens element, including:

1) an entrance surface which includes a number of hyperboloidal surfaces corresponding to the number of LED's, the hyperboloidal surfaces being centered on respective beam axes of respective LED's and having hyperboloidal surface edges generally corresponding to the respective beam widths of the respective LED's, the hyperboloidal surfaces receiving respective emitted beams, each hyperboloidal surface being shaped to refract the emitted beam into an intra-lens lens light beam whose components travel substantially parallel paths; and 2) an exit surface including at least one facet shaped to refract the intra-lens light beam into a desired output beam, the facets being grouped into subsets of facets, the subsets arranged to refract intra-lens light from respective ones of the hyperboloidal surfaces into a desired output beam; and d) a housing, including:

1) a baffle arrangement oriented around each LED and adjacent the board, to substantially surround sides of the LED to reduce the amount of light which falls upon the LED;

2) a first set of attachment structures for attaching the housing to the board on which the LED's are attached; and 3) a second attachment structure for matingly engaging a corresponding lens attachment structure on a lens element, so that the lens element may be fixed to the housing.

18. An apparatus for emanating electromagnetic radiation as a desired output beams, the apparatus comprising:

a) at least one emitting device for producing an emitted beam of electromagnetic radiation; and b) a lens element including, for each emitting device;

1) an entrance surface shaped to refract the emitted beam into an intra-lens beam; and 2) an exit surface including at least one facet shaped to refract the intra-lens beam into the desired output beam;

wherein:

A) the emitting device is located at a focus of the lens entrance surface; and

B) wherein at least one facet of the exit surface is formed with an imaginary center of curvature that is located off an imaginary center line passing midway between a first set of opposite edges of the facet and perpendicular to a line connecting the opposite edges, so that the desired output beam is skewed in a first direction with respect to the axis of the intra-lens beam.

19. The apparatus of claim 18, wherein the imaginary center of curvature is located off the imaginary center line passing midway between a second set of opposite edges of the facet and perpendicular to a line connecting the second set of opposite edges, so that the desired output beam is skewed in a second direction with respect to the axis of the intra-lens beam.

20. An apparatus for emanating electromagnetic radiation as a desired output beam, the apparatus comprising:

a) at least one emitting device for producing an emitted beam of electromagnetic radiation; and b) a lens element including, for each emitting device;

1) an entrance surface shaped to refract the emitted beam into an intra-lens beam; and 2) an exit surface including at least one facet shaped to refract the intra-lens beam into the desired output beam;

wherein:

A) the emitting device is located at a focus of the lens entrance surface;

B) the exit surface includes:

1) a first facet having a first radius of curvature defining its outer surface so that it emits an output beam subtending a first angle in a first direction and a second angle in a second direction, the first facet emanating electromagnetic energy having a first beam spread; and 2) a second facet having a second radius of curvature defining its outer surface so that it emits an output beam subtending a third angle in a third direction and a fourth angle in a fourth direction, the second facet emanating electromagnetic energy having a second beam spread;

C) at least one of the first and second angles is not the same as a corresponding one of the third and fourth angles, so that the first beam spread is different in angularity, or intensity, or angularity and intensity, than the second beam spread.

21. An apparatus for emanating electromagnetic radiation as a desired output beam, the apparatus comprising:

a) at least one emitting device for producing an emitted beam of electromagnetic radiation;

b) a lens element including, for each emitting device;

1) an entrance surface shaped to refract the emitted beam into an intra-lens beam; and 2) an exit surface including at least one facet shaped to refract the intra-lens beam into the desired output beam;

wherein the emitting device is located at a focus of the lens entrance surface c) a board on which the at lest one emitting device is situated; and d) a housing, including:

1) a baffle arrangement oriented around each emitting device and adjacent the board, to substantially surround sides of the emitting device to reduce the amount of electromagnetic radiation which falls upon the emitting device;

2) a first set of attachment structures for attaching the housing to the board on which the emitting devices are attached; and 3) a second attachment structure for matingly engaging a corresponding lens attachment structure on the lens element, so that the lens element may be fixed to the housing.

22. An apparatus for emanating electromagnetic radiation as a desired output beam, the apparatus comprising:

a) at least one emitting device for producing an emitted beam of electromagnetic radiation; and b) a lens element including, for each emitting device;

1) an entrance surface adapted to refract the emitted beam into an intra-lens beam; and 2) an exit surface including at least one facet shaped to refract the intra-lens beam into the desired output beam;

wherein:

A) the emitting device is located at a focus of the lens entrance surface;

B) the at least one emitting device includes LED's, the emitted beams of the LED's having respective beam spreads and beam axes; and C) the lens element is constructed and arranged so that:

1) the lens element entrance surface includes a number of hyperboloidal surfaces corresponding to the number of LED's, the hyperboloidal surfaces being centered on respective beam axes of respective LED's and having hyperboloidal surface edges generally corresponding to the respective beam spreads of the respective LED's, the hyperboloidal surfaces receiving respective emitted beams;

2) each hyperboloidal surface is shaped to refract the emitted beam into an intra-lens beam whose components travel substantially parallel paths; and 3) the facets are grouped into subsets of facts, the subsets arranged to receive intra-lens beams from respective ones of the hyperboloidal surfaces.

23. The apparatus of claim 22, wherein there are exactly four LED's, four hyperboloidal surfaces, and four rows and twelve columns of facets including four subsets of twelve facets.

24. The apparatus of claim 23, wherein each facet has an outer surface which subtends a horizontal angle of about 36°42'and a vertical angle of about 12°2', the resultant desired output beam subtending a projected angle of about 18° horizontally and 6° vertically.

25. An apparatus for emanating electromagnetic radiation as a desired output beam, the apparatus comprising:

a) at least one emitting device for producing an emitted beam of electromagnetic radiation, the at least one emitting device having respective characteristic beam spreads and beam axes, the beam spreads defining generally cone-shaped regions within which the electromagnetic radiation is concentrated and outside of which electromagnetic radiation is substantially reduced or eliminated; and b) a least element including, for each emitting device:

1) an entrance surface shaped to refract the emitted beam into an intra-lens beam, the lens element positioned with respect to the emitting device so that edges of the entrance surface substantially correspond to edges of the characteristic beam spread; and 2) an exit surface including at least one facet shaped to refract the intra-lens beam into the desired output beam;

wherein the emitting device is located at a focus of the lens entrance surface,

26. The apparatus of claim 25, wherein at least one of the emitting devices is a light emitting diode (LED).

27. The apparatus of claim 25, wherein the entrance surface includes a portion of a hyperboloid having a focus at which is located one of the emitting devices.

28. The apparatus of claim 25, wherein the entrance surface is shaped to refract the emitted beam into an intra-lens beam substantially all of whose electromagnetic energy travels in an essentially parallel direction.

29. The apparatus of claim 25, wherein the facet of the exit surface is convex.

30. The apparatus of claim 25, wherein the facet of the exit surface is concave.

31. The apparatus of claim 25, wherein the facet of the exit surface is formed with an imaginary center of curvature which is located on an imaginary center line passing midway between opposite edges of the facet and perpendicular to a line connecting the opposite edges, so that the desired output beam is substantially on-axis to the direction of the intra-lens beam.

32. The apparatus of claim 25, wherein at least one facet of the exit surface is formed with an imaginary center of curvature that is located off an imaginary center line passing midway between a first set of opposite edges of the facet and perpendicular to a line connecting the opposite edges, so that the desired output beam is skewed in a first direction with respect to the axis of the intra-lens beam.

33. The apparatus of claim 32, wherein the imaginary center of curvature is located off the imaginary center line passing midway between a second set of opposite edges of the facet and perpendicular to a line connecting the second set of opposite edges, so that the desired output beam is skewed in a second direction with respect to the axis of the intra-lens beam.

34. The apparatus of claim 25, wherein the exit surface includes:

a first facet having a first radius of curvature defining its outer surface so that it emits an output beam subtending a first angle in a first direction and a second angle in a second direction, the first facet emanating electromagnetic energy having a first beam spread; and a second facet having a second radius of curvature defining its outer surface so that it emits an output beam subtending a third angle in a third direction and a fourth angle in a fourth direction, the second facet emanating electromagnetic energy having a second beam spread;

wherein at least one of the first and second angles is not the same as a corresponding one of the third and fourth angles, so that the first beam spread is different in angularity, or intensity, or angularity and intensity, than the second beam spread.

35. The apparatus of claim 25, further comprising a housing which includes:

a baffle arrangement for each emitting device, oriented to substantially surround sides of the emitting device to minimize the amount of electromagnetic radiation which falls upon the emitting device.

36. The apparatus of claim 25, further comprising:

a) a board on which the at least one emitting device is situated; and b) a housing, including:

1) a baffle arrangement oriented around each emitting device and adjacent the board, to substantially surround sides of the emitting device to reduce the amount of electromagnetic radiation which falls upon the emitting device;

2) a first set of attachment structures for attaching the housing to the board on which the emitting devices are attached; and 3) a second attachment structure for matingly engaging a corresponding least attachment structure on the lens element, so that the lens element may be fixed to the housing.

37. The apparatus of claim 25, wherein:

a) the at least one emitting device includes LED's, the emitted beams of the LED's having respective beam spreads and beam axes; and b) the lens element is constructed and arranged so that:

1) the lens element entrance surface includes a number of hyperboloidal surfaces corresponding to the number of LED's, the hyperboloidal surfaces being centered on respective beam axes of respective LED's and having hyperboloidal surface edges generally corresponding to the respective beam spreads of the respective LED's, the hyperboloidal surfaces receiving respective emitted beams;

2) each hyperboloidal surface is shaped to refract the emitted beam into an intra-lens beam whose components travel substantially parallel paths; and 3) the facets are grouped into subsets of facets, the subsets arranged to receive intra-lens beams from respective ones of the hyperboloidal surfaces.

38. The apparatus of claim 37, wherein there are exactly four LED's, four hyperboloidal surfaces, and four rows and twelve columns of facets including four subsets of twelve facets.

39. The apparats of claim 38, wherein each facet has an outer surface which subtends a horizontal angle of about 36°42′ and a vertical angle of about 12°2′, the resultant desired output beam subtending a projected angle of about 18° horizontally and 6° vertically.

40. The apparatus of claim 25, wherein the emitting device includes a device for emitting electromagnetic energy lying substantially within the light spectrum visible to humans.

* * * * *

UNITED STATES PATENT AND TRADEMARK OFFICE

CERTIFICATE OF CORRECTION

PATENT NO. : 5,174,649

DATED : December 29, 1992

INVENTOR(S) : Kevin G. Alston

It is certified that error appears in the above-identified patent and that said Letters Patent is hereby corrected as shown below:

Col. 8:

Claim 1, line 9, after "intra-lens" insert --beam--.

Claim 3, line 3, "of" (first occurrence) should be --at--.

Col. 9:

Claim 10, line 18, "angularly" should be --angularity--.

Col. 10:

Claim 18, line 2, "beams" should be --beam--.

Col. 11:

Claim 21, line 14, "lest" should be --least--.

Col. 12:

Claim 25, line 12, "least" should be --lens--.

Col. 14:

Claim 36, line 14, "least" should be --lens--.

Claim 39, line 1, "apparats" should be --apparatus--.

Signed and Sealed this

Second Day of May, 1995

*Attest:*

*Attesting Officer*

BRUCE LEHMAN

*Commissioner of Patents and Trademarks*

US005174649B1

REEXAMINATION CERTIFICATE (3489th)

United States Patent [19]

[11] B1 5,174,649

Alston

[45] Certificate Issued Apr. 14, 1998

[54] LED LAMP INCLUDING REFRACTIVE LENS ELEMENT

[75] Inventor: Kevin G. Alston, Wylie, Tex.

[73] Assignee: Precision Solar Controls Inc., Garland, Tex.

Reexamination Request:
No. 90/004,283, Jun. 24, 1996

Reexamination Certificate for:

| | |
|---|---|
| Patent No.: | **5,174,649** |
| Issued: | **Dec. 29, 1992** |
| Appl. No.: | **731,621** |
| Filed: | **Jul. 17, 1991** |

Certificate of Correction issued May 2, 1995.

[51] Int. Cl.[6] ..... F21V 5/00

[52] U.S. Cl. ..... 362/244; 362/309; 362/332; 362/800

[58] Field of Search ..... 362/244, 236, 362/237, 268, 308, 309, 331, 332, 335, 800; 359/622, 624, 794

[56] References Cited

U.S. PATENT DOCUMENTS

| | | | |
|---|---|---|---|
| 1,342,894 | 6/1920 | Bugbee | 362/268 |
| 1,977,120 | 10/1934 | Dirkes et al. | 362/268 |
| 2,082,100 | 6/1937 | Dorey et al. | 362/330 |
| 2,215,203 | 9/1940 | Young | 362/268 |
| 2,254,961 | 9/1941 | Harris | 362/327 X |
| 2,401,171 | 5/1946 | Leppert | 362/244 |
| 2,908,197 | 10/1959 | Wells et al. | 340/815.76 |
| 3,035,486 | 5/1962 | Benford | 362/268 |
| 3,119,894 | 1/1964 | Nagel et al. | 340/815.76 |
| 3,302,517 | 2/1967 | Henkel | 362/268 |
| 3,522,424 | 8/1970 | Fritsch | 362/268 |
| 4,013,915 | 3/1977 | Dufft | 313/499 |
| 4,271,408 | 6/1981 | Teshima et al. | 340/702 |
| 4,330,813 | 5/1982 | Deutsch | 362/244 |
| 4,425,604 | 1/1984 | Imai et al. | 362/223 |
| 4,521,835 | 6/1985 | Meggs et al. | 362/183 |
| 4,619,508 | 10/1986 | Shibuya et al. | 362/268 X |
| 4,684,919 | 8/1987 | Hihi | 340/84 |
| 4,698,730 | 10/1987 | Sakai et al. | 362/311 |
| 4,729,076 | 3/1988 | Masami et al. | 362/235 |
| 4,733,335 | 3/1988 | Serizawa et al. | 362/80 |
| 4,935,665 | 6/1990 | Murata | 313/500 |
| 4,951,179 | 8/1990 | Machida | 362/61 |
| 4,953,937 | 9/1990 | Kikuchi et al. | 362/335 X |

FOREIGN PATENT DOCUMENTS

| | | |
|---|---|---|
| A-0 389 724 | 10/1990 | European Pat. Off. . |
| A-0 415 026 | 3/1991 | European Pat. Off. . |
| 61-185980 | 8/1986 | Japan . |
| 63-4009 | 1/1988 | Japan . |
| 63-155782 | 6/1988 | Japan . |

*Primary Examiner*—Stephen F. Husar

[57] ABSTRACT

A lamp includes one or more LED's which illuminate respective portions of a refractive lens element whose incident surface preferably includes portions of hyperboloids which translate the LEDs' emitted rays into substantially parallel beams within the lens element. The lens element's exit surface is preferably an array of facets configured to provide a desired beam spread pattern, allowing precise tailoring of the resultant output beam pattern. The plurality of facets also allows a larger area on the lamp to appear to viewers to be uniformly illuminated, thus providing full target size definition at a decreased cost and with reduced power consumption.

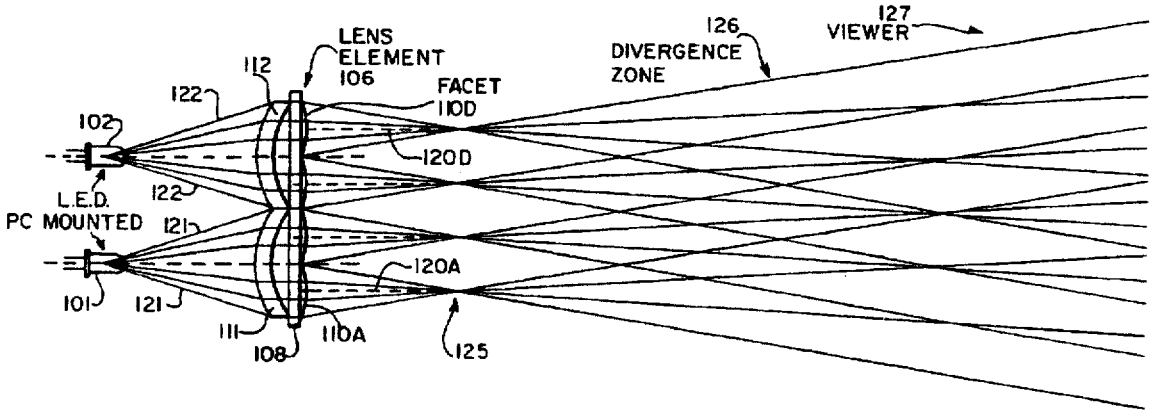

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 3, 17–40 is confirmed.

Claims 2, 5–8 and 10–13 & 16 are determined to be patentable as amended.

Claims 4, 9, 14 and 15, dependent on an amended claim, are determined to be patentable.

[2. The apparatus of claim 1,] *An apparatus for emanating electromagnetic radiation as a desired output beam, the apparatus comprising;*

*a) at least one emitting device for producing an emitted beam of electromagnetic radiation; and*

*b) a lens element including, for each emitting device;*

*1) an entrance surface shaped to refract the emitted beam into an intra-lens beam; and*

*2) an exit surface including at least two facets shaped to refract the intra-lens beam into the desired output beam;*

*wherein the emitting device is located at a focus of the lens entrance surface and* [wherein] at least one of the emitting devices is a light emitting diode (LED).

5. [The apparatus of claim 1,] *An apparatus for emanating electromagnetic radiation as a desired output beam, the apparatus comprising:*

*a) at least one emitting device for producing an emitted beam of electromagnetic radiation; and*

*b) a lens element including, for each emitting device:*

*1) an entrance surface shaped to refract the emitted beam into an intra-lens beam; and*

*2) an exit surface including at least two facets shaped to refract the intra-lens beam into the desired output beam;*

*wherein the emitting device is located at a focus of the lens entrance surface and* [wherein] at least one facet of the exit surface is convex.

6. [The apparatus of claim 1,] *An apparatus for emanating electromagnetic radiation as a desired output beam, the apparatus comprising:*

*a) at least one emitting device for producing an emitted beam of electromagnetic radiation; and*

*b) a lens element including, for each emitting device;*

*1) an entrance surface shaped to refract the emitted beam into an intra-lens beam; and*

*2) an exit surface including at least two facets shaped to refract the intra-lens beam into the desired output beam;*

*wherein the emitting device is located at a focus of the lens entrance surface and* [wherein] at least one facet of the exit surface is concave.

7. [The apparatus of claim 1,] *An apparatus for emanating electromagnetic radiation as a desired output beam, the apparatus comprising:*

*a) at least one emitting device for producing an emitted beam of electromagnetic radiation; and,*

*b) a lens element including, for each emitting device;*

*1) an entrance surface shaped to refract the emitted beam into an intra-lens beam; and,*

*2) an exit surface including at least two facets shaped to refract the intra-lens beam into the desired output beam;*

*wherein the emitting device is located at a focus of the lens entrance surface and* [wherein] at least one facet of the exit surface is formed with an imaginary center of curvature which is located on an imaginary center line passing midway between opposite edges of the facet and perpendicular to a line connecting the opposite edges, so that the desired output beam is substantially on-axis to the direction of the intra-lens beam.

8. [The apparatus of claim 1] *An apparatus for emanating electromagnetic radiation as a desired output beam, the apparatus comprising:*

*a) at least one emitting device for producing an emitted beam of electromagnetic radiation; and*

*b) a lens element including, for each emitting device;*

*1) an entrance surface shaped to refract the emitted beam into an intra-lens beam; and*

*2) an exit surface including at least two facets shaped to refract the intra-lens beam into the desired output beam;*

*wherein the emitting device is located at a focus of the lens entrance and* [wherein] at least one facet of the exit surface is formed with an imaginary center of curvature that is located off an imaginary center line passing midway between a first set of opposite edges of the facet and perpendicular to a line connecting the opposite edges, so that the desired output [lens] *beam* is skewed in a first direction with respect to the axis of the intra-lens beam.

10. [The apparatus of claim 1,] *An apparatus for emanating electromagnetic radiation as a desired output beam, the apparatus comprising:*

*a) at least one emitting device for producing an emitted beam of electromagnetic radiation; and*

*b) a lens element including for each emitting device;*

*1) an entrance surface shaped to refract the emitted beam into an intra-lens beam; and*

*2) an exit surface including at least two facets shaped to refract the intra-lens beam into the desired output beam;*

*wherein the emitting device is located at a focus of the lens entrance surface and* [wherein] the exit suface includes:

a first facet having a first radius of curvature defining its outer surface so that it emits an output beam subtending a first angle in a first direction and a second angle in a second direction, the first facet emanating electromagnetic energy having a first beam spread; and a second facet having a second radius of curvature defining its outer surface so that it emits an output beam subtending a third angle in a third direction and a fourth angle in a fourth direction, the second facet emanating electromagnetic energy having a second beam spread;

wherein at least one of the first and second angles is not the same as a corresponding one of the third and fourth angles, so that the first beam spread is different in angularity, or intensity, or angularity and intensity, than the second beam spread.

11. [The apparatus of claim 1, further comprising] *An apparatus for emanating electromagnetic radiation as a desired output beam, the apparatus comprising:*

*a) at least one emitting device for producing an emitted beam of electromagnetic radiation;*

*b) a lens element including, for each emitting device;*

*1) an entrance surface shaped to refract the emitted beam into an intra-lens beam, the emitting device being located at a focus of the lens entrance surface; and*

*2) an exit surface including at least two facets shaped to refract the intra-lens beam into the desired output beam; and* c) a housing which includes:

a baffle arrangement for each emitting device, oriented to substantially surround sides of the emitting device to minimize the amount of electromagnetic radiation which falls upon the emitting device.

12. [The apparatus of claim 1, further comprising:] *An apparatus for emanating electromagnetic radiation as a desired output beam, the apparatus comprising:*

*a) at least one emitting device for producing an emitted beam of electromagnetic radiation;*

*b) a lens element including, for each emitting device;*

*1) an entrance surface shaped to refract the emitted beam into an intra-lens beam, the emitting device being located at a focus of the lens entrance surface; and*

*2) an exit surface including at least two facets shaped to refract the intra-lens into the desired output beam;*

[a)] *c)* a board on which the at least one emitting device is situated; and

[b)] *d)* a housing, including:

1) a baffle arrangement oriented around each emitting device and adjacent the board, to substantially surround sides of the emitting device to reduce the amount of electromagnetic radiation which falls upon the emitting device;

2) a first set of attachment structures for attaching the housing to the board on which the emitting devices are attached; and 3) a second attachment structure for matingly engaging a corresponding lens attachment structure on the lens element, so that the lens element may be fixed to the housing.

13. [The apparatus of claim 1,] *An apparatus for emanating electromagnetic radiation as a desired output beam, the apparatus comprising:*

*a) at least one emitting device for producing an emitted beam of electromagnetic radiation; and*

*b) a lens element including, for each emitting device;*

*1) an entrance surface shaped to refract the emitted beam into an intra-lens beam, the emitting device being located at a focus of the lens entrance surface; and*

*2) an exit surface including at least two facets shaped to refract the intra-lens beam into the desired output beam;* wherein:

a) the at least one emitting device includes LED's, the emitted beam of the LED's having respective beam spread and beam axes; and b) the lens element is constructed and arranged so that:

1) the lens element entrance surface includes a number of hyperboloidal surfaces corresponding to the number of LED's, the hyperboloidal surfaces being centered on respective beam axes of respective LED's and having hyperboloidal surface edges generally corresponding to the respective beam spreads of the respective LED's, the hyperboloidal surface receiving respective emitted beams;

2) each hyperboloidal surface is shaped to refract the emitted beam into an intra-lens beam whose components travel substantially parallel paths; and 3) the facets are grouped into subsets of facets, the subsets arranged to receive intra-lens beams from respective ones of the hyperboloidal surfaces.

16. The apparatus of claim *1* wherein the emitting device includes a device for emitting electromagnetic energy lying substantially within the light spectrum visible to humans.

* * * * *